US009635460B2

(12) United States Patent
Schultz et al.

(10) Patent No.: US 9,635,460 B2
(45) Date of Patent: Apr. 25, 2017

(54) SENSITIVITY ADJUSTMENT APPARATUS AND METHOD FOR MEMS DEVICES

(75) Inventors: Jordan T. Schultz, Chicago, IL (US); Weiwen Dai, Elgin, IL (US); Peter V. Loeppert, Durand, IL (US)

(73) Assignee: Knowles Electronics, LLC, Itasca, IL (US)

( * ) Notice: Subject to any disclaimer, the term of this patent is extended or adjusted under 35 U.S.C. 154(b) by 334 days.

(21) Appl. No.: 13/586,999

(22) Filed: Aug. 16, 2012

(65) Prior Publication Data

US 2013/0044898 A1 Feb. 21, 2013

Related U.S. Application Data

(60) Provisional application No. 61/524,907, filed on Aug. 18, 2011.

(51) Int. Cl.

| | |
|---|---|
| ***H04R 3/06*** | (2006.01) |
| *H04R 19/00* | (2006.01) |
| *H04R 19/04* | (2006.01) |

(52) U.S. Cl.

CPC ..... *H04R 3/06* (2013.01); *H04R 19/005* (2013.01); *H04R 19/04* (2013.01)

(58) Field of Classification Search

CPC ..... H04R 19/005; H04R 23/00; H04R 3/00; H04R 19/04; H04R 3/06; H04R 2410/00; H04R 29/00; H04R 29/004; H04R 1/005; H04R 19/016; H04R 11/04; H03G 3/00; H03G 3/3026; H03G 3/20; H03F 3/04; H03M 1/12

USPC ..... 381/111, 113, 120, 107, 123, 174, 8, 59, 381/122, 98, 58; 384/111, 8, 107, 113

See application file for complete search history.

(56) References Cited

U.S. PATENT DOCUMENTS

| | | | | |
|---|---|---|---|---|
| 6,226,386 | B1 * | 5/2001 | Akino | H04R 3/00 381/114 |
| 7,190,038 | B2 | 3/2007 | Dehe et al. | |
| 7,473,572 | B2 | 1/2009 | Dehe et al. | |

(Continued)

FOREIGN PATENT DOCUMENTS

| | | | |
|---|---|---|---|
| CN | 101621728 | A | 1/2010 |
| JP | 08331696 | A | 12/1996 |
| JP | 2006087074 | A | 3/2006 |

OTHER PUBLICATIONS

International Search Report and Written Opinion for related PCT Application No. PCT/US2012/051154, Feb. 26, 2013,10 pages.

(Continued)

*Primary Examiner* — Xu Mei
*Assistant Examiner* — Ubachukwu Odunukwe
(74) *Attorney, Agent, or Firm* — Foley & Lardner LLP

(57) ABSTRACT

A microelectromechanical (MEMS) microphone includes a MEMS motor and a gain adjustment apparatus. The MEMS motor includes at least a diaphragm and a charge plate and is configured to receive sound energy and transform the sound energy into an electrical signal. The gain adjustment apparatus has an input and an output and is coupled to the MEMS motor. The gain adjustment apparatus is configured to receive the electrical signal from the MEMS motor at the input and adjust the gain of the electrical signal as measured from the output of the gain adjustment apparatus. The amount of gain is selected so as to obtain a favorable sensitivity for the microphone.

20 Claims, 6 Drawing Sheets

(56) References Cited

U.S. PATENT DOCUMENTS 7,781,249 B2 8/2010 Laming et al.
7,795,695 B2 9/2010 Weigold et al.
7,825,484 B2 11/2010 Martin et al.
7,829,961 B2 11/2010 Hsiao
7,856,804 B2 12/2010 Laming et al.
7,903,831 B2 3/2011 Song
8,625,809 B2 * 1/2014 Josefsson et al. ..... 381/8
8,687,823 B2 4/2014 Loeppert
9,059,630 B2 6/2015 Gueorguiev
2001/0036287 A1 * 11/2001 Beard et al. ..... 381/313
2004/0179702 A1 * 9/2004 Boor ..... 381/111
2005/0069164 A1 * 3/2005 Muthuswamy et al. ..... 381/369
2005/0207605 A1 9/2005 Dehe et al.
2006/0062406 A1 * 3/2006 Kinoshita ..... 381/113
2006/0147061 A1 7/2006 Niwa et al.
2007/0201710 A1 * 8/2007 Suzuki et al. ..... 381/174
2007/0278501 A1 12/2007 Macpherson et al.
2008/0075306 A1 * 3/2008 Poulsen et al. ..... 381/111
2008/0079444 A1 * 4/2008 Denison ..... 324/679
2008/0175425 A1 7/2008 Roberts et al.
2008/0267431 A1 10/2008 Leidl et al.
2008/0279407 A1 11/2008 Pahl
2008/0283942 A1 11/2008 Huang et al.
2009/0001553 A1 1/2009 Pahl et al.
2009/0003629 A1 * 1/2009 Shajaan et al. ..... 381/113
2009/0180655 A1 7/2009 Tien et al.
2009/0285414 A1 * 11/2009 Wu ..... H04R 3/06 381/113
2009/0316935 A1 * 12/2009 Furst et al. ..... 381/111
2010/0046780 A1 2/2010 Song
2010/0052082 A1 3/2010 Lee et al.
2010/0128914 A1 5/2010 Khenkin
2010/0183181 A1 7/2010 Wang
2010/0246859 A1 * 9/2010 David et al. ..... 381/120
2010/0246877 A1 9/2010 Wang et al.
2010/0290644 A1 11/2010 Wu et al.
2010/0310096 A1 * 12/2010 Josefsson ..... H04R 3/06 381/113
2010/0322443 A1 12/2010 Wu et al.
2010/0322451 A1 12/2010 Wu et al.
2011/0013787 A1 1/2011 Chang
2011/0075875 A1 3/2011 Wu et al.
2011/0135118 A1 * 6/2011 Osborne ..... 381/122
2011/0142261 A1 * 6/2011 Josefsson ..... H04R 3/00 381/107
2011/0158454 A1 * 6/2011 Takano et al. ..... 381/369
2011/0172996 A1 * 7/2011 Takano et al. ..... 704/225
2011/0267212 A1 * 11/2011 Denison ..... 341/122
2013/0051582 A1 * 2/2013 Kropfitsch ..... H03F 1/56 381/111
2013/0058506 A1 3/2013 Boor
2013/0136267 A1 * 5/2013 Hammerschmidt ..... H04R 3/06 381/58
2013/0271307 A1 * 10/2013 Kropfitsch ..... H03G 3/002 341/158
2014/0177113 A1 6/2014 Gueorguiev
2014/0197887 A1 7/2014 Hovesten
2015/0058001 A1 2/2015 Dai
2015/0063594 A1 3/2015 Nielsen
2015/0256916 A1 9/2015 Volk

OTHER PUBLICATIONS

English-language machine translation of CN 101621728, Beijing Acuti Microsystems Co., Ltd. (Jan. 6, 2010).

* cited by examiner

SENSITIVITY ADJUSTMENT APPARATUS AND METHOD FOR MEMS DEVICES

CROSS REFERENCE TO RELATED APPLICATIONS

This patent claims benefit under 35 U.S.C. §119 (e) to U.S. Provisional Application No. 61/524,907 entitled "Sensitivity Adjustment Apparatus And Method For MEMS Devices" filed Aug. 18, 2011, the content of which is incorporated herein by reference in its entirety.

TECHNICAL FIELD

This application relates to acoustic devices and, more specifically, to their performance.

BACKGROUND OF THE INVENTION

Various types of microphones and receivers have been used through the years. In these devices, different electrical components are housed together within a housing or assembly. For example, a microphone typically includes microelectromechanical system (MEMS) device, a diaphragm, and integrated circuits, among other components and these components are housed within the housing. Other types of acoustic devices may include other types of components.

One characteristic that is used to define whether a microphone is operating properly is its sensitivity. The sensitivity of a microphone is typically determined by transmitting sound energy into the microphone and then measuring the response of the microphone, for example, its output voltage. Although sensitivity can be measured in a variety of different units, in one example, it is measured in units of "dBV/Pa" (As is known, 1 Pa=94 dB re 20 μPa).

Various manufacturers of different products (e.g., cell phones, personal computers, and hearing aids to mention a few examples) utilize microphones. Typically, the manufacturer selects a nominal sensitivity as the acceptable sensitivity for the microphones that it is using. Additionally, the manufacturer may provide a sensitivity range in which some variation of sensitivity is allowed. That is, if the sensitivity of an individual microphone is not required to be exactly at the nominal sensitivity; if the sensitivity falls within the range, the microphone is deemed to still have acceptable performance. To take one specific example, a nominal sensitivity may be X dBV/Pa and this be allowed to vary in a range of X +/−3 dB (X−3 dBV/Pa to X+3 dBV/Pa).

In recent years, the sensitivity ranges give by many manufacturers have been tightened into smaller ranges in order to provide for improved performance. Unfortunately, these tightened ranges have resulted in more devices falling outside the range. Consequently, when a device falls outside the acceptable range the manufacturer typically rejects the part resulting in the need to obtain a replacement part thereby increasing costs. Additionally, dissatisfaction with the suppliers of the microphones has also occurred when too many parts were found to have an unacceptable performance. No previous approach has been provided that adequately addresses these problems.

BRIEF DESCRIPTION OF THE DRAWINGS

For a more complete understanding of the disclosure, reference should be made to the following detailed description and accompanying drawings wherein.

Figure 1:
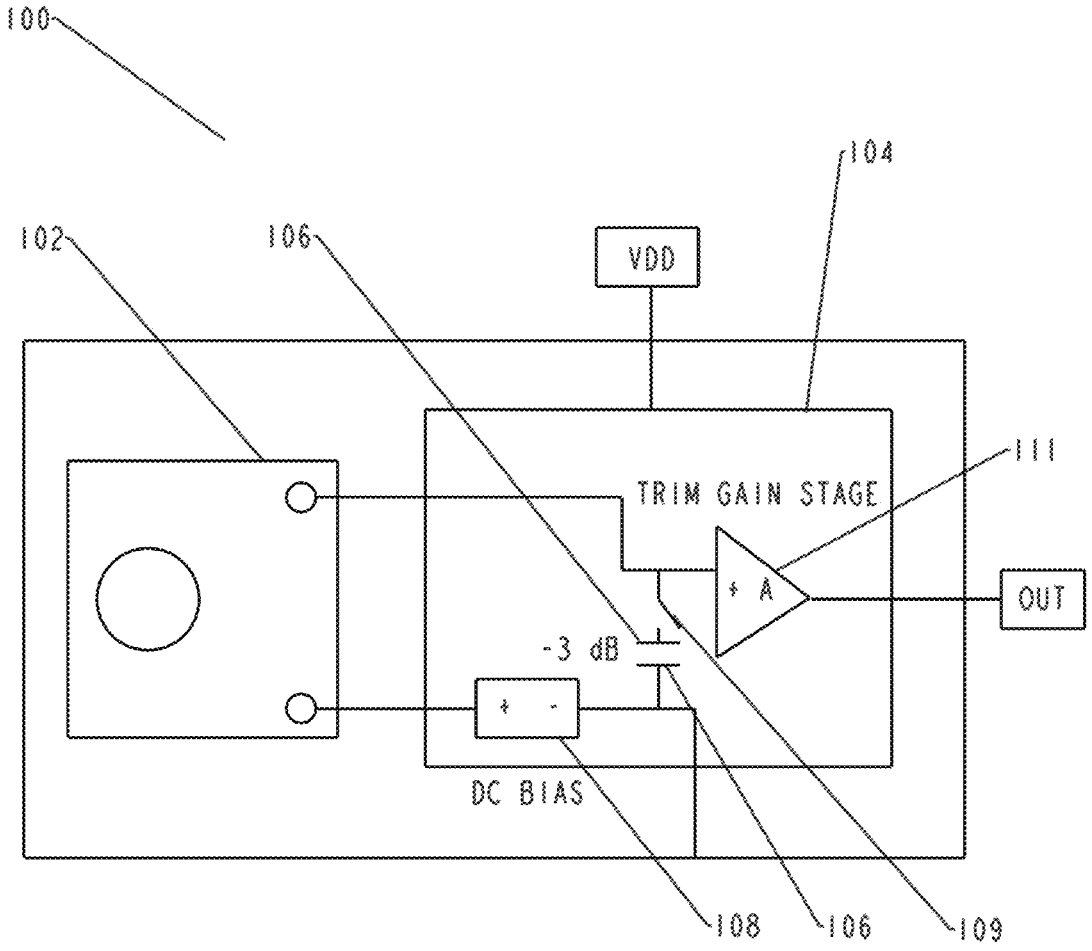
FIG. 1 is a block diagram of an apparatus for providing dynamic or permanent sensitivity adjustment for an acoustic device (e.g., a microphone) according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Microphones and other acoustic devices are provided that allow the sensitivity of a MEMS device (e.g., a MEMS microphone) to be dynamically (or permanently) adjusted. In one aspect, this may be accomplished by dynamically or permanently adjusting the gain of the microphone. In so doing, a microphone device that has an initial sensitivity that falls outside the range can have its sensitivity adjusted so that its new sensitivity falls within the acceptable range. As a result, a device that previously would have been discarded (or at least not used) for having unacceptable performance can have its gain adjusted to improve its performance to fall within acceptable limits. The approaches described herein are easy and cost effective to implement, and significantly reduce the number of devices that are rejected due to these devices not meeting performance standards or criteria.

In many of these embodiments, a microelectromechanical (MEMS) microphone includes a MEMS motor and a gain adjustment apparatus. The MEMS motor includes at least a diaphragm and a charge plate and is configured to receive sound energy and transform the sound energy into an electrical signal. The gain adjustment apparatus has an input and an output and is coupled to the MEMS motor. The gain adjustment apparatus is configured to receive the electrical signal from the MEMS motor at the input and adjust the gain of the electrical signal as measured from the output of the gain adjustment apparatus. The amount of gain is selected so as to obtain a favorable sensitivity for the microphone.

In some aspects, the gain adjustment apparatus comprises a plurality of switchable resistors and/or switchable capacitors. In other aspects, the gain adjustment apparatus includes a switch to select at least one element that adjusts the gain of the electrical signal. In some examples, the gain adjustment apparatus is configured to be adjusted dynamically while in others the gain adjustment apparatus is configured to be adjusted permanently.

In others of these embodiments, the sensitivity of a MEMS microphone is measured at a predetermined frequency. When the sensitivity is unacceptable, a dynamic adjustment is made to the gain of the microphone. Subsequently, the sensitivity of the microphone is measured to determine whether the measured sensitivity is acceptable.

Figure 2A:
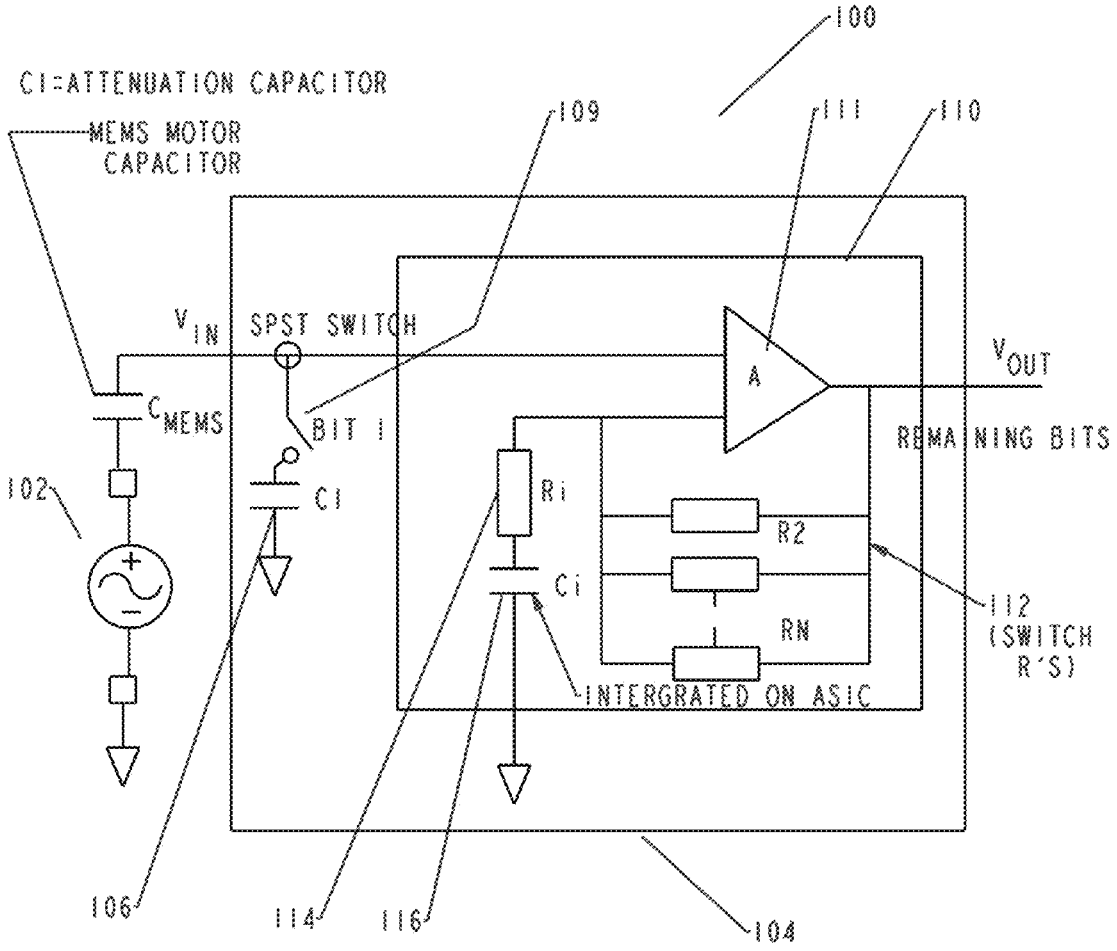
FIG. 2A is a circuit diagram of the apparatus of FIG. 1 that provides dynamic or permanent sensitivity adjustment for an acoustic device (e.g., a microphone) with switchable resistors in parallel according to various embodiments of the present invention.
Figure 2B:
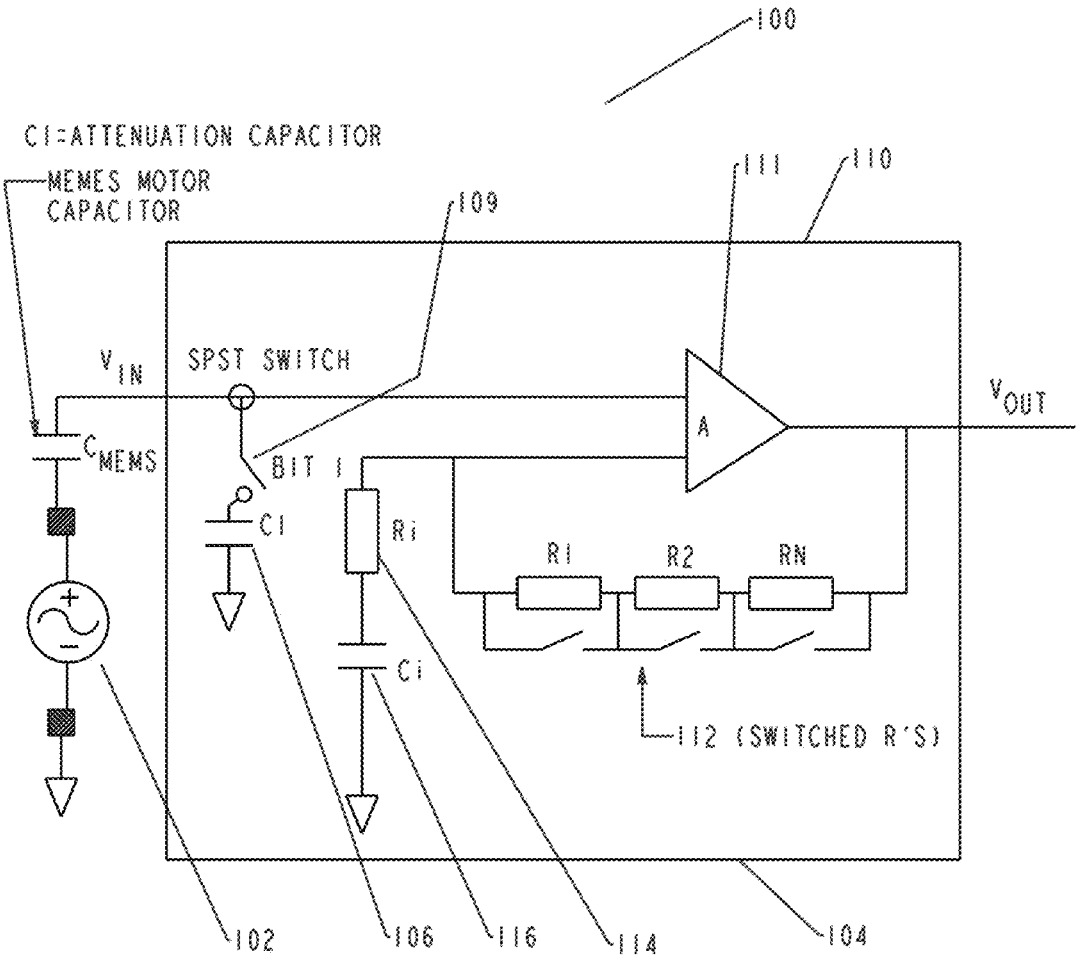
FIG. 2B is circuit diagram of the apparatus of FIG. 1 that provides dynamic or permanent sensitivity adjustment for an acoustic device (e.g., a microphone) as an alternative to the circuit of FIG. 2A with switchable resistors in series according to various embodiments of the present invention.
Figure 3:
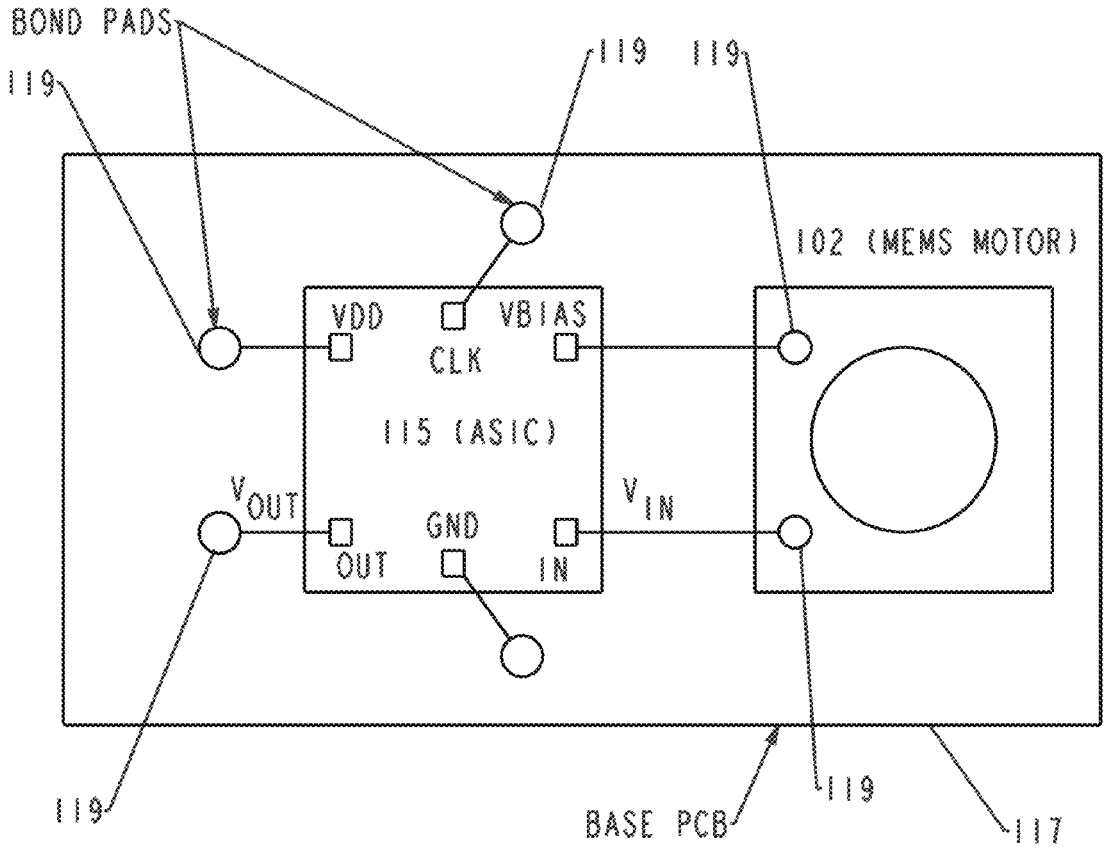
FIG. 3 is a block diagram of the apparatus of FIG. 1 and FIG. 2 that provides dynamic or permanent sensitivity adjustment for an acoustic device (e.g., a microphone) according to various embodiments of the present invention.

Referring now to FIG. 1, FIG. 2A, FIG. 2B, and FIG. 3 one example of a MEMS microphone 100 that provides for dynamic or permanent gain adjustment is described. The microphone 100 includes a MEMS motor 102 and a gain adjustment apparatus 104. The gain adjustment apparatus 104 includes a switchable capacitor 106, dc bias 108, and gain stage 110. The gain stage 110 includes an amplifier 111, switchable resistors 112, an input resistor 114, and a filter capacitor 116. The components of the gain stage 110 as well as the attenuation capacitor 106 may be incorporated into an application specific integrated circuit (ASIC) 115. The ASIC 115 and MEMS motor 102 are incorporated into or on a printed circuit board (PCB) 117. As shown especially in FIG. 3, various pads are used to make connections between elements and also connect the microphone 100 to outside devices. The function of the dc bias 108 is to provide a dc bias voltage for the MEMS motor 102. It will be appreciated that FIG. 2A shows the resistors 112 connected in parallel and, alternatively, FIG. 2B shows the resistors connected in series. A user can select the particular configuration (FIG. 2A or FIG. 2B) that is desired.

The MEMS motor 102 may include a diaphragm, charge plate and other elements that are not discussed further herein. The MEMS motor 102 can be represented electrically as an alternating current (AC) source and capacitor that are connected electrically in series. The MEMS motor 102 receives sound energy and transforms this sound energy into an electrical signal.

The amplifier 111 may be any operational amplifier. The switchable capacitor 106 can be included into the circuit manually by a user (e.g., by throwing a switch 109 or automatically by a computer actuating the switch 109. In one example, when the capacitor 106 is used for attenuation of the alternating potential created by the moving motor, the user can achieve the desired attenuation by adjusting the value of capacitor 106.

It will be appreciated that any number of switchable capacitors 106 may be used and these may be switched in and out of the circuit of FIG. 1, FIG. 2A, and FIG. 2B in any combination to change the amount of attenuation provided. In this respect, each of the capacitors has an associated switch that when actuated places the capacitor into the circuit.

To take example of using multiple capacitors, if three capacitors are used in parallel (instead of the one capacitor shown in FIG. 1, FIG. 2A and FIG. 2B), then all three capacitors may be switched into the circuit; alternatively, any two of the three capacitors may be switched into the circuit in any combination; or in another alternative any one of the capacitors may be switched in the circuit in any combination. In still another alternative, none of the three capacitors may be switched into the circuit. Thus, the amount of attenuation that is applied to $V_{OUT}$ may be adjusted dynamically or permanently depending upon the values and/or numbers of the capacitors switched into the circuit.

The switchable resistors 112 are a combination of n resistors that are connected individually dependent on the gain value needed. One (or more) of these individual resistors is selected so that the gain can be adjusted as desired. The adjustment of the resistance changes the gain provided by the amplifier 111 at $V_{OUT}$. It is possible to use either a combination of parallel resistors (as in FIG. 2A) or series resistors (as in FIG. 2B) to achieve the desired gain through calculations known to those skilled in the art.

Figure 5:
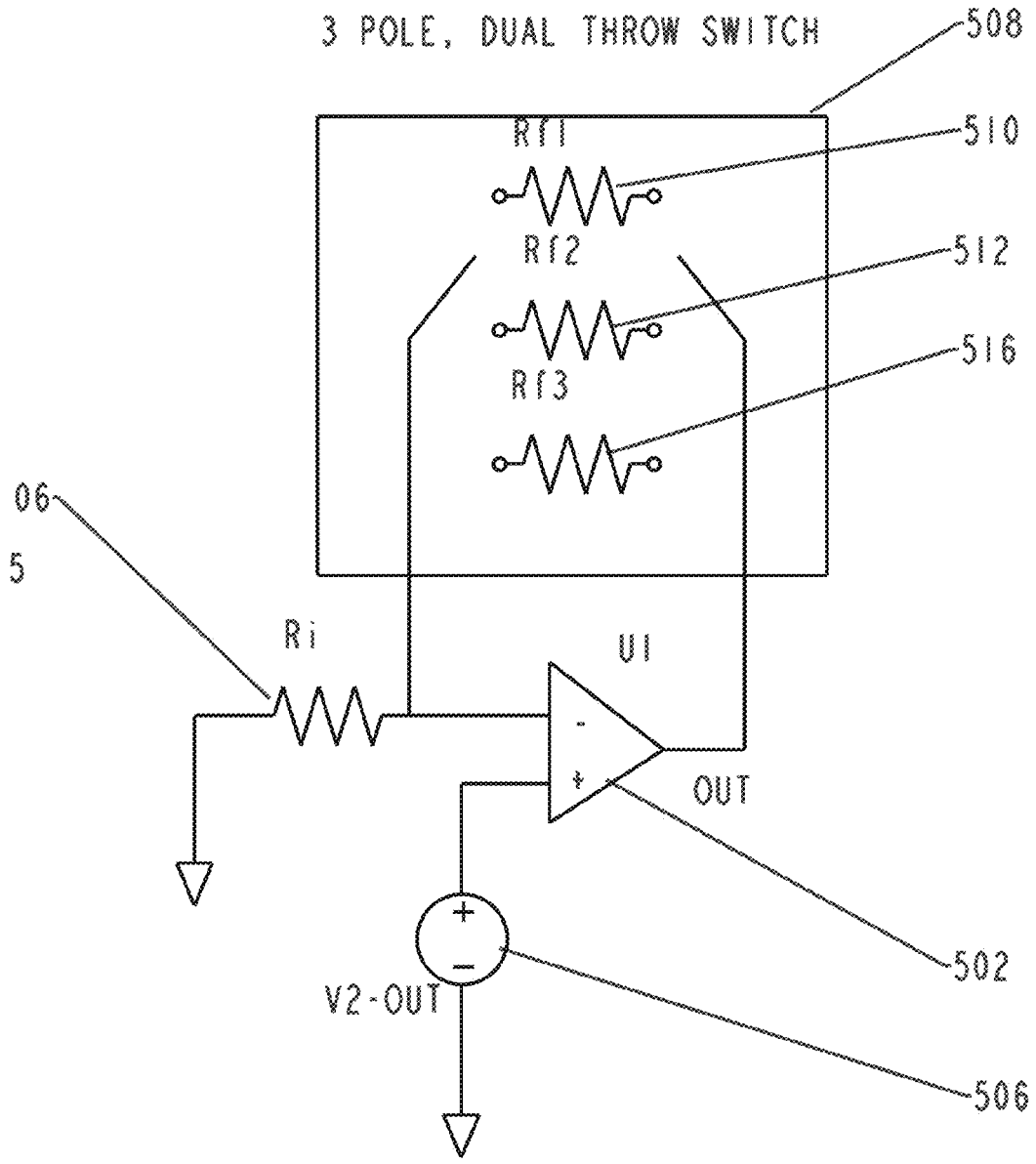
FIG. 5 is a block diagram of a switching arrangement for the gain control resistors for providing dynamic or permanent sensitivity adjustment for an acoustic device (e.g., a microphone) according to various embodiments of the present invention.

Any resistor 112 can be dynamically or permanently switched into the circuit of FIG. 1, FIG. 2A, FIG. 2B and FIG. 3 (e.g., they may be a tunable potentiometer device) manually by a user or automatically by a computer or computer-like device. For instance, a certain digital bit pattern can be input into the microphone 100 and based upon this bit pattern, an individual one of the resistors 112 is selected to be included into the circuit that is so formed. By adjusting the value of this resistance, the amount of gain can be adjusted. Another example includes series resistors with respective switches, or combine parallel resistors with respective switches to adjust the amount of gain dynamically or permanently (e.g., as shown in FIG. 5 with XPYT switches—X being number of poles/Y being the number of throws needed for parallel switching). In the circuit of FIG. 2A, the resistors 112 are in parallel while in the circuit of FIG. 2B the resistors are in series.

Consequently, the sensitivity value of the microphone (at $V_{OUT}$) is adjusted by switching in the capacitor 106 and/or the resistors 112. The particular combination of elements selected to be switched into the circuit depends upon the measured sensitivity and the final sensitivity value that is desired.

The output voltage ($V_{OUT}$) of the circuit of FIG. 1, FIG. 2A, FIG. 2B, and FIG. 3 is equal to:

$$((C_{MEMS})/((C_{MEMS}+(C_{IN}+C_{SW})))*V_{MEMS} \quad (1)$$

where $C_{MEMS}$ is the capacitance of the MEMS motor 102, $C_{IN}$ is equal to the capacitance of the ASIC 115 in parallel with the parasitic capacitance of the system (looking out of the motor), and $C_{SW}$ is the capacitance of the capacitor 106. It will be appreciated that this output voltage can be calculated and then the value $20*\log_{10}(V_{OUT})$ can be obtained. This final value is the sensitivity S. It will be appreciated that as $C_{SW}$ is increased, the term $(C_{IN}+C_{SW})$ in equation (1) can no longer be ignored due to the increased contribution of $C_{SW}$ and the output voltage ($V_{OUT}$) is increasingly affected. In one example, the value $C_{SW}$ is chosen so that −3 dB of attenuation is provided to $V_{OUT}$. Other examples of values are possible.

It will also be understood that various approaches can be used to determine and execute any adjustments that include the switchable capacitor 106 and the resistors 112 into the circuits of FIG. 1, FIG. 2A, FIG. 2B, and FIG. 3. For example, a microphone may be tested and after the sensitivity is measured/determined a user may determine whether to manually switch the capacitor 106 and/or the resistors 112 (i.e., how many of the resistors) into the circuit. On the other hand, the microphone may be tested and after the sensitivity is determined, then a computer or computer-like device may automatically determine whether to switch in the capacitor 106 and/or the resistors 112 (i.e., how many of the resistors) into the circuit. With either approach, after the final determination is made, the particular configuration of capacitor/resistors that were selected may be permanently incorporated into the circuit by, for example, permanently throwing or burning in switch settings.

In one example, of the operation of the system of FIG. 1, FIG. 2A, FIG. 2B, and FIG. 3 it is assumed that the nominal value for sensitivity is X dBV/Pa. It is also assumed that the sensitivity range is +/−1 dB such that a part may be judged acceptable if its sensitivity falls between X−1 dBV/Pa and X+1 dBV/Pa. It will be appreciated that these values are examples only and that other values are possible.

A first microphone may be tested, and to take one example, the measured value at $V_{OUT}$ is X−0.5 dBV/Pa Since this value is within the acceptable range, no adjustment is made (i.e., the capacitor 106 and the resistors 112 are not switched into the circuit).

Another microphone is tested and the measured sensitivity value at $V_{OUT}$ is X+1.5 dBV/Pa. As will be appreciated, this is not within the acceptable range. The capacitor 106 (with an attenuation of −3 dB) is switched into the circuit and the result is X−2.5 dBV/Pa. This value, however, is still outside the acceptable range (X−1 dBV/Pa to X+1 dBV/Pa in this example) so that resistors 112 are next selected so as to provide X+1.5 dB of gain. Adding this gain to the circuit produces sensitivity of X−1 dBV/Pa, which is within the desired range.

In still another example of application of the approaches described herein, another microphone is tested and the measured result for its sensitivity at $V_{OUT}$ is X−2 dBV/Pa. Adding the capacitor 106 will decrease this value (moving away from the desired—XdBV/Pa) so the capacitor is not included (i.e., switched into) in the circuit. However, the resistors 112 can be switched into the circuit to provide a gain of +2 dB and change the sensitivity value from X−2 dBV/Pa to X dBV/Pa. It will be appreciated that in any of the examples described herein, the resistors can be added to the circuit incrementally. For instance and to take this example, one resistor can be added that gives a gain of 0.5 dB, a new test performed, and then another resistor added to see if the result will fall within the acceptable range until the measured value at $V_{OUT}$ falls within the acceptable range.

Figure 4:
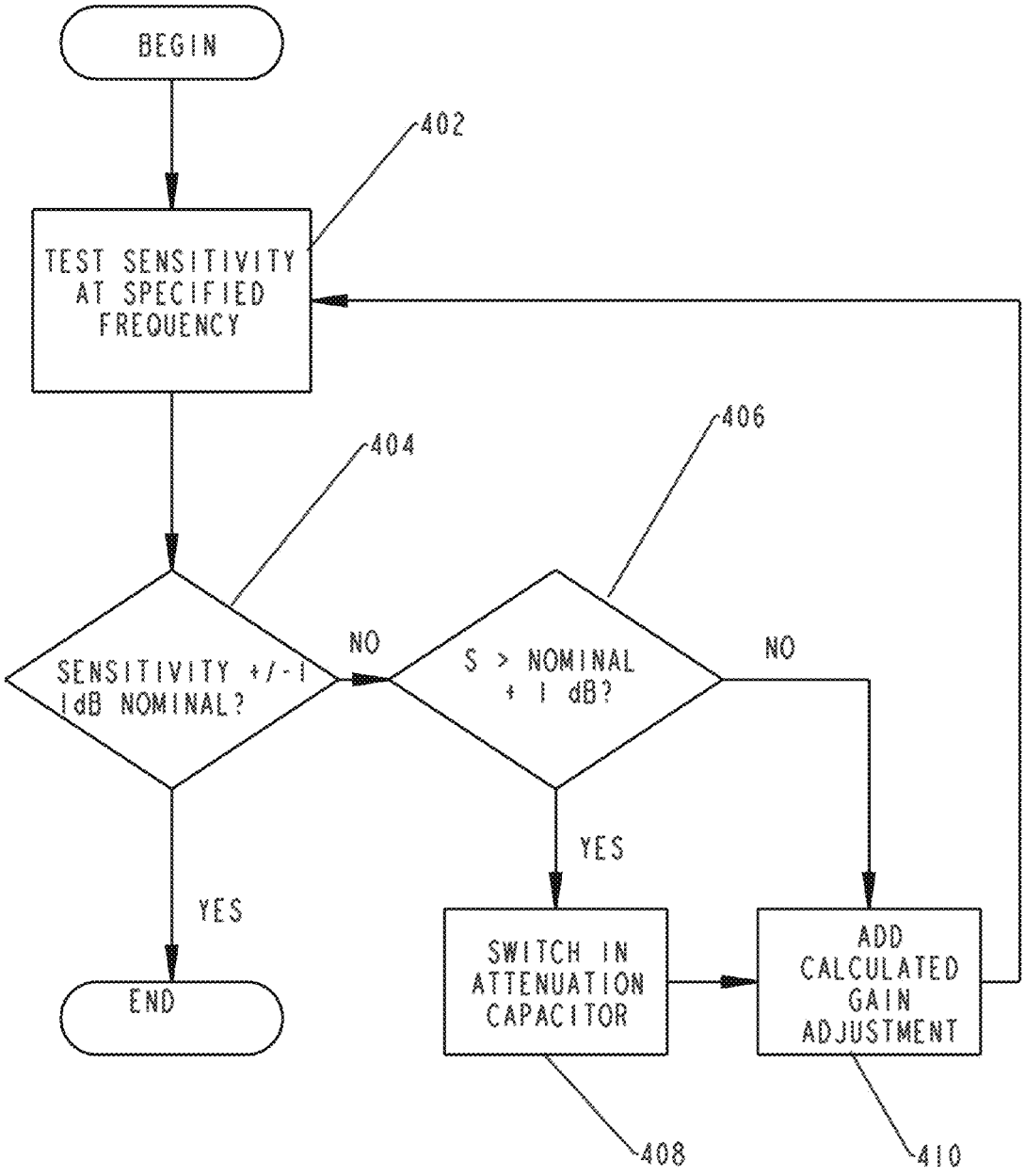
FIG. 4 is a flow chart of an approach for providing dynamic or permanent sensitivity adjustment for an acoustic device (e.g., a microphone) according to various embodiments of the present invention.

Referring now to FIG. 4, one example of an approach for dynamic or permanent sensitivity adjustment is described. It will be appreciated that this particular example includes specific numerical values for nominal values, ranges, attenuations, and/or gains. However, these numerical values are example values only and can be changed to suit the needs or requirements of different users or manufacturers. It will also be understood that the example of FIG. 4 utilized the circuit of FIG. 1, FIG. 2, and FIG. 3.

At step 402, the sensitivity of the microphone is tested at a specific frequency. For example, at 1 kHz, 1 Pa=1 N/m^2 of sound energy can be applied to the microphone.

At step 404, it is determined whether the sensitivity is plus or minus (+/−) 1 dB of the nominal sensitivity. For example, if the nominal sensitivity is X dBV/Pa, it is determined if the measured sensitivity is between X−1 dBV/Pa and X+1 dBV/Pa (i.e., the nominal sensitivity range). If the answer at step 404 is affirmative, execution ends and the part is judged to be acceptable (i.e., it has a sensitivity that falls within the acceptable sensitivity range). If the answer is negative, execution continues at step 406.

At step 406, it is determined whether the measured sensitivity is greater than the nominal sensitivity plus 1 dB. For example, if the nominal sensitivity is X dBV/Pa, it is determined if the measured sensitivity is greater than X+1 dBV/Pa. If the answer is affirmative, then execution continues at step 408 and if the answer is negative, execution continues at step 410 as described below.

At step 408, the attenuation capacitor is switched into the circuit. In one example, the attenuation capacitor may provide −3 dB of gain. To continue with the present example, if the measured reading at step 406 were X+2 dBV/Pa, step 408 would be executed and −3 dB of attenuation switched in to the circuit to provide a sensitivity of X−1 dBV/Pa.

At step 410, a gain adjustment is calculated and the resistors of the gain adjustor added into the circuit to give the desired final result. To continue with the present example, after step 408 was completed and the gain was now X−1 dBV/Pa, then the gain resistors are added to give +1 dB of gain to obtain the final desired result of X dBV/Pa. It will be appreciated that the final result may not exactly X dBV/Pa and that the final result will come as close to the nominal value as possible given the values of the resistors. Control then returns to step 402 where another test is performed and the process described above is repeated.

In another example, if the measured sensitivity were less than nominal plus 1 dB, step 408 is not executed and control continues at step 410. For example, if the measured sensitivity were X−3 dBV/Pa, then the capacitor is never switched into the circuit and only the resistors are used to move the sensitivity from X−3 dBV/Pa to the desired nominal value of X dBV/Pa.

It will be appreciate that the above-mentioned adjustments may be made incrementally. For example, one resistor of the parallel resistor combination may be added, a new test may be performed to see if the sensitivity is within rage, and then another resistor added in parallel and so forth until the measured sensitivity falls within the acceptable range.

In one aspect, using a standard inverting amplifier with a gain of −Rf/Ri an adjustable gain is established. This can be done, as shown in FIG. 2B, by having multiple resistors in series—for example if the use would like a gain stage of three steps, they would use three feedback resistors controlled by switches to control the gain. Each resistor would have a specific value used to control the ratio of −Rf/Ri for specific gain values. It should be noted that a non-inverting amplifier stage with a gain of approximately 1+Rf/Ri can be used as well.

Referring now to FIG. 5, another example of a switching arrangement for the gain control resistors of the present approaches is described. The circuit of FIG. 5 includes an op-amp 502, input resistor 504, bias voltage 506 ($V_{OUT}$), and a three pole, dual throw switch 508. The switch 506 selects between resistors 510, 512, or 516. Selecting as between these resistors gives an adjustable gain.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A microelectromechanical (MEMS) microphone comprising:

a MEMS motor, the MEMS motor including at least a diaphragm and a charge plate, the MEMS motor configured to receive sound energy and transform the sound energy into an electrical signal;

a gain adjustment apparatus, disposed on an integrated circuit and coupled to the MEMS motor, the gain adjustment apparatus comprising:

an input configured to receive the electrical signal from the MEMS motor;

an output;

an amplifier configured to provide an output voltage at the output based upon a gain provided by the amplifier and the electrical signal; and a plurality of switchable capacitors, each of the plurality of switchable capacitors configured to be selectively connected to the input;

wherein selective connection of the plurality of switchable capacitors to the input causes a sensitivity of the MEMS microphone to be within a predetermined specific target sensitivity range for the MEMS microphone; and wherein the plurality of switchable capacitors attenuate the output based at least in part upon a capacitance of the MEMS motor, a capacitance of the plurality of switchable capacitors that are connected to the input, and a capacitance of the integrated circuit.

2. The MEMS microphone of claim 1, wherein the gain adjustment apparatus is configured to be adjusted dynamically.

3. The MEMS microphone of claim 1, wherein the gain adjustment apparatus is configured to be adjusted permanently.

4. The MEMS microphone of claim 1, wherein at least two of the plurality of switchable capacitors are connected to the MEMS motor to attenuate the electrical signal from the MEMS motor to the amplifier.

5. The MEMS microphone of claim 1, wherein the gain adjustment apparatus further comprises a plurality of resistors, wherein at least one of the plurality of resistors is connected to the amplifier to change the gain of the amplifier.

6. The MEMS microphone of claim 5, wherein at least two of the plurality of resistors are connected to the amplifier to change the gain of the amplifier.

7. The MEMS microphone of claim 6, wherein the at least two of the plurality of resistors are in parallel to one another.

8. The MEMS microphone of claim 6, wherein the at least two of the plurality of resistors are in series to one another.

9. The MEMS microphone of claim 6, wherein the at least two of the plurality of resistors have different resistance values.

10. The MEMS microphone of claim 5, further comprising one or more switches, each of the one or more switches configured to connect one or more of the plurality of resistors to the amplifier.

11. The MEMS microphone of claim 1, further comprising one or more switches, each of the one or more switches configured to connect one or more of the plurality of switchable capacitors to the input.

12. The MEMS microphone of claim 1, wherein at least one of the plurality of switchable capacitors attenuates the electrical signal by 3 dB.

13. The MEMS microphone of claim 1, wherein the predetermined specific target sensitivity range for the MEMS microphone is a voltage range corresponding to an intensity of the sound energy.

14. A method of adjusting a microelectromechanical (MEMS) microphone, the method comprising:

setting a specific target sensitivity value for the MEMS microphone;

determining an initial sensitivity value of the MEMS microphone at a predetermined frequency during operation of the MEMS microphone, the MEMS microphone including a MEMS motor that transmits a signal to an amplifier;

determining that the initial sensitivity value is outside a predetermined range of the specific target sensitivity value; and adjusting an amount of attenuation of the MEMS microphone by selectively actuating one or more switchable capacitors, wherein the one or more switchable capacitors achieve the specific target sensitivity value based at least in part upon the initial sensitivity value of the MEMS microphone, a capacitance of the MEMS motor, capacitance of the actuated one or more capacitors and a capacitance of the integrated circuit.

15. The method of claim 14, further comprising permanently adjusting the attenuation of the MEMS microphone.

16. The method of claim 14, further comprising, wherein at least two switchable capacitors are selectively actuated.

17. The method of claim 14, further comprising:

determining a second sensitivity value of the MEMS microphone at the predetermined frequency during operation of the MEMS microphone based at least upon the selectively actuated one or more switchable capacitors;

determining that the second sensitivity value is outside the predetermined range of the specific target sensitivity value; and adjusting, at the adjustment apparatus, a second amount of attenuation of the MEMS microphone by selectively actuating one or more switchable resistors.

18. The method of claim 17, further comprising:

determining a third sensitivity value of the MEMS microphone at the predetermined frequency during operation of the MEMS microphone based at least upon the selectively actuated one or more switchable capacitors and the selectively actuated one or more switchable resistors; and determining that the third sensitivity value is within the predetermined range of the specific target sensitivity value.

19. The method of claim 17, wherein said adjusting the amount of attenuation of the MEMS microphone is performed before said adjusting the second amount of attenuation of the MEMS microphone.

20. The method of claim 17, wherein said adjusting the second amount of attenuation of the MEMS microphone comprises increasing a gain of the MEMS microphone.

* * * * *